US006061971A

United States Patent [19]

Wolters et al.

[11] Patent Number: 6,061,971

[45] Date of Patent: May 16, 2000

[54] PUBLIC TERMINAL

[75] Inventors: Theodorus Bernardus Wolters, An Delft; Guido Ignatius Bernardus Gardien, Cd Best, both of Netherlands

[73] Assignee: Koninklijke KPN N.V., Netherlands

[21] Appl. No.: 09/125,880

[22] PCT Filed: Mar. 25, 1997

[86] PCT No.: PCT/EP97/01554

§ 371 Date: Mar. 5, 1999

§ 102(e) Date: Mar. 5, 1999

[87] PCT Pub. No.: WO97/36071

PCT Pub. Date: Oct. 2, 1997

[30] Foreign Application Priority Data

| | | | |
|---|---|---|---|
| Mar. 25, 1996 | [NL] | Netherlands | 1002703 |
| Sep. 24, 1996 | [NL] | Netherlands | 1004103 |

[51] Int. Cl.[7] ..... E04H 1/14

[52] U.S. Cl. ..... 52/27.5; 52/40; 52/730.1; 312/265.3

[58] Field of Search ..... 52/27.5, 36.1, 52/40, 730.1, 730.2, 730.4, 730.5; 312/265.1, 265.3, 265.4; 40/606

[56] References Cited

U.S. PATENT DOCUMENTS

| | | | |
|---|---|---|---|
| 2,328,618 | 9/1943 | Corso | 52/27.5 X |
| 3,192,306 | 6/1965 | Skonnord | 312/265.4 X |
| 3,338,002 | 8/1967 | Ericsson et al. | 52/27.5 X |
| 3,921,345 | 11/1975 | Damico | 52/36.1 X |
| 4,113,331 | 9/1978 | Derdzinski et al. | 312/265.4 X |
| 5,921,795 | 7/1999 | Weener et al. | 52/36.1 X |

FOREIGN PATENT DOCUMENTS

| | | |
|---|---|---|
| 1 162 335 | 9/1958 | France . |
| 2 127 182 | 10/1972 | France . |
| 2 337 528 | 8/1977 | France . |
| 93 06 094 U | 6/1993 | Germany . |
| WO 93/24920 | 12/1993 | WIPO . |

*Primary Examiner*—Beth A. Aubrey
*Assistant Examiner*—Brian E. Glessner
*Attorney, Agent, or Firm*—Michaelson & Wallace; Peter L. Michaelson

[57] ABSTRACT

Public terminal whose housing is formed by shaft-shaped segments (4, 5, 6) which, from a base plinth (2), extend vertically and, by means of connecting elements (10) extending vertically as well, are connected to one another, with the processing units (7) at the rear side and lateral sides being enclosed by the shaft-shaped segments. The segments are stably attached to the base plinth by means of tie rods (8) on the one side engaging with the base plinth, which extend through the shaft-shaped segments, and which on the other side engage with the top side of said segments. The shafts formed by the segments may be used, if so desired, for cooling or thermal insulation of the incorporated equipment. The segments are preferably manufactured by means of extrusion.

4 Claims, 2 Drawing Sheets

PUBLIC TERMINAL

A. BACKGROUND OF THE INVENTION

The invention relates to a public terminal for publicly making available information, telecommunication or other services, with the operating functions required for that purpose being capable of being carried out by means of processing units included in the terminal.

Examples of such terminals are: public-telephone columns, emergency telephones of the [Dutch] AA, and ticket-vending machines for public transport. Such terminals are formed by a plinth having either a substantially tubular support and, above it, an operator console cased in a secure housing, such as in the event of the emergency telephone, or, if the size of the necessary terminal equipment so requires, by a more ample housing of steel plate mounted directly onto the plinth, such as in the event of the Dutch Railway Company's ticket-vending machine.

B. SUMMARY OF THE INVENTION

The object of the invention is to provide a combination of the two current main versions of public terminals, with attention being paid, inter alia, to aesthetic design, mechanical strength and stability, weather resistance, maintainability and accessibility of the internal equipment etc. According to the invention, the terminal housing is formed by shaft-shaped segments which, from a base plinth, extend vertically, and are connected to one another by means of likewise vertically extending connecting elements, with the processing units being enclosed, on the rear side and lateral sides, by the shaft-shaped segments. The invention is based on the insight that shaft-shaped segments, such as "walls", for a public terminal offer the options which correspond to the requirements imposed. Thus, each of the segments, independently from one another, may be mounted stably onto a base plinth (concrete plinth or steel base plate), namely by means of tie rods engaging, on the one side, with the base plinth, which extend through at least a number of the shaft-shaped segments, and which on the other side engage with a point of action on the side turned away from the base plinth (therefore with the top side) of said segments. The tie rods must therefore have a considerable length, in the order of magnitude of the height of the shaft-shaped segments, as a result of which, due to the elastic deformation of the tie rods in longitudinal direction ("elongation"), the shaft-shaped segments, even at fluctuating temperatures, always remain well-tightened to the base plinth. The tie rods are preferably at least partially enclosed by tie-rod guides extending within the shaft-shaped segments.

The shaft-shaped segments are preferably provided with connection elements extending in the longitudinal direction of the shaft-shaped segments, which engage with one another along the entire length of the said segments, as a result of which the segments together form a housing of the terminal equipment which is impermeable from the outside. The terminal housing as a whole, is preferably substantially cylindrical, with the shaft-shaped segments having a cross-sectional shape which is equal, or closely related, to the geometrical shape of a circular segment, i.e., aruluar.

Apart from the fact that, using the shaft-shaped segments, there may be obtained a very stable terminal housing which—even at fluctuating temperatures, but also in the event of vibrations due to road or railway traffic—is rigidly connected to the base plinth, the shafts formed by the segments may be used, if so desired, for cooling, whether forced or not, of the incorporated equipment. In addition, the shafts may be filled with thermal-insulation material, e.g., for applications at very low temperatures.

The shaft-shaped segments are preferably manufactured by means of an extrusion process, as a result of which the price is relatively low. In the event of extrusion, there is produced a semifinished product, e.g., of aluminium, having a profile equal to that of the shaft-shaped segments, including tie-rod guides, however having a great length, e.g., of 50 meters. Afterwards, said semifinished-product profile is sewn to the desired length of, e.g., 1.50 meters, to form lateral and rear sides of the terminal, respectively. Since in the event of extrusion it is not possible to extrude projections transversely to the extrusion direction, this manufacturing method requires the use of long tie rods which on the one side engage with the bottom side, by way of the plinth, and on the other side with the top side, e.g., by way of tie-rod nuts. The use of tie rods, which extend through the entire lateral and rear sides of the terminal, respectively, therefore stems from the manufacturing method of the segments. In addition, the great length and the relatively great material elongation of the tie rods achieve a very sound and reliable attachment to the plinth or base plate.

EXEMPLARY EMBODIMENTS

DETAILED DESCRIPTON

Figure 1:
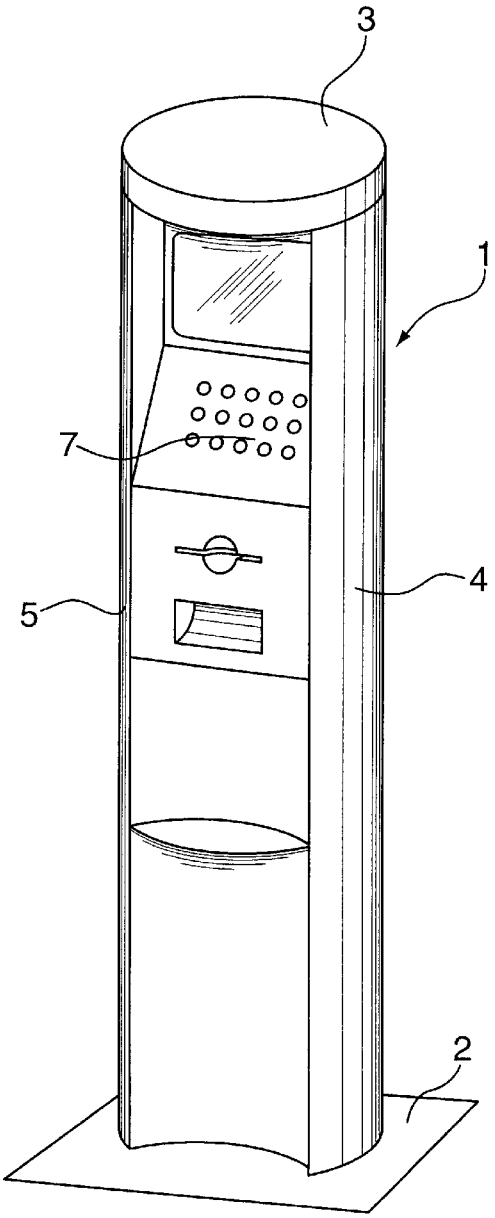
FIG. 1 shows a public terminal according to a preferred embodiment of the invention.

FIG. 1 shows a terminal 1, mounted on a base plate 2, the walls of which are formed by shaft-shaped segments 4, 5 and 6 (shown in FIG. 2), closed off on top by a lid 3. In the housing, there is mounted equipment 7 to be operated at the front side. The example given schematically shows a screen, a keyboard, a card reader and a printer. Such a terminal may be used, e.g., for obtaining information on public transport. Also, the terminal may be used, e.g., as ticket-vending or admission-ticket machine for public transport or for events, or as a public-telephone terminal.

Figure 2:
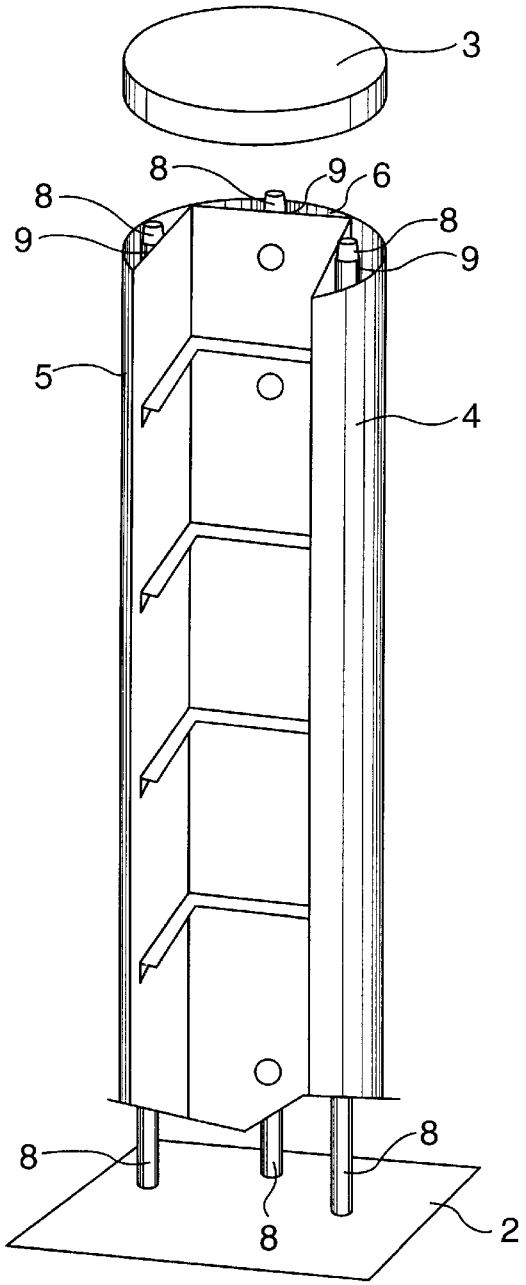
FIG. 2 shows the attachment of the terminal to the plinth by means of tie rods.

FIG. 2 schematically shows the construction of the terminal housing. The walls 4, 5 and 6 are shaft-shaped, while on the outside they integrally form a kind of upright tube open at the front side. The walls are connected to one another by connecting elements running through from bottom to top, which are integral with the walls. On the inside, the walls form a rather rectangular space, which may be used for placing, on supports, the terminal equipment: display unit, keyboard unit etc. The walls are pulled onto the base plate 2 by tie rods 8, which run through substantially the entire wall, from top to bottom. They are enclosed by tie-rod guides 9, which are integral with the inside of the wall shaft. The wall shafts themselves are of aluminium and are manufactured, including the connecting elements and tie-rod guides, by means of extrusion. Bottom and top ends of the tie rods are provided with thread, with which the tie rods are screwed into the base plate 2 at the bottom side. The top sides of the tie rods engage with the end of the tie-rod guides by means of nuts screwed onto the tie rods, with which these are tightened. Due to the great length of the tie rods, these operate as resilient elements, with which the walls are held tightly against the base plate. As a result, it is achieved that the terminal housing, even in the event of vibrations, shocks and temperature fluctuations, continues to be pulled against the base plate. The inside—and the outside—of the walls may be provided with vent holes for cooling the built-in equipment.

Figure 3:
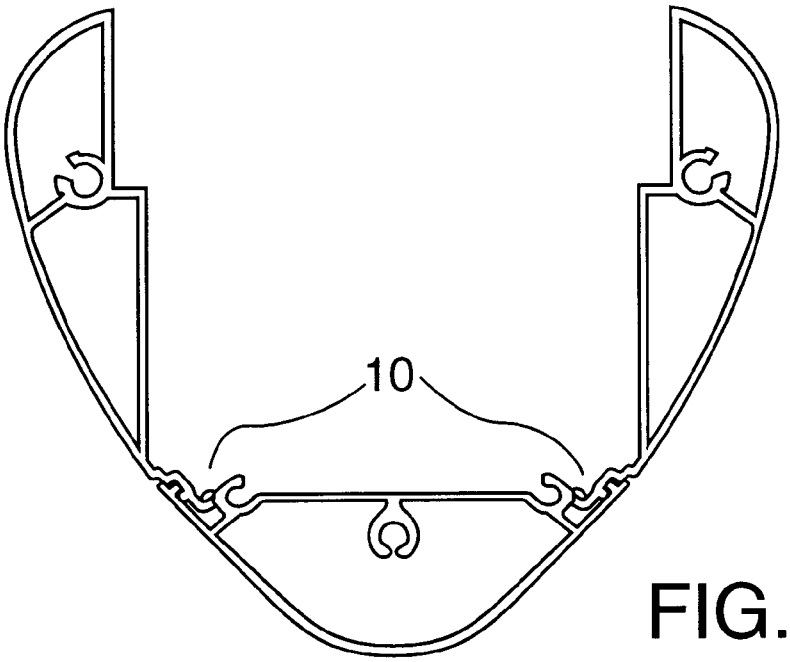
FIG. 3 shows a cross section of the terminal housing in a shape as it is now actually being implemented.

FIG 3. shows yet another cross section of the extruded aluminium-wall profiles as these will now be used in practice. On it, there is also indicated the way in which the walls are attached to one another, namely, by means of co-extruded connecting elements (10), which are shown in more detail in FIG. 4.

Figure 4:
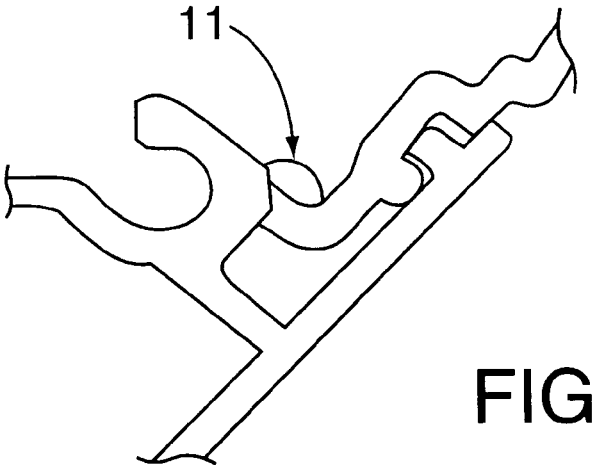
FIG. 4 shows the cross section of the connecting elements in detail.

FIG. 4 shows the connecting profiles 10 of two adjacent walls "snapped" together. The profiles make it possible, during the mounting of a terminal housing, to quickly connect the three required walls to one another. Moreover, for safety's sake the connecting elements are welded to one another (11).

We claim:

1. A housing for a terminal, the terminal being intended for use by an individual for interacting with a processing unit situated within the terminal housing to obtain information, undertake telecommunication or obtain other services through the processing unit, the terminal housing comprising:

shaft-shaped segments which, from a base plinth, extend vertically, wherein the processing unit, at rear and lateral sides thereof, is adapted to be enclosed by the shaft-shaped segments and said shaft-shaped segments have longitudinally extruded profiles; and a plurality of tie rods which engage, on a common side of each of said tie rods, with the base plinth, and extend longitudinally through the shaft-shaped segments, and, on an opposite common side of each of the tie rods, engage with a point of action situated on a common side of said shaft-shaped segments situated opposite from the base plinth.

2. The terminal according to claim 1 further comprising tie-rod guides which enclose a portion of said tie rods and which are located within said shaft-shaped elements and extend longitudinally therein.

3. The terminal according to claim 1 further comprising connecting elements extending in said shaft-shaped segments and along a longitudinal direction of said segments and engaging with one another along an entire length of said shaft-shaped segments.

4. The terminal according to claim 1 wherein each of the shaft-shaped segments has a substantially circular cross-sectional shape.

* * * * *